United States Patent [19]

Bolza-Schunemann

[11] 4,391,191

[45] Jul. 5, 1983

[54] RECIPROCAL SUPPORTING ARRANGEMENT FOR CONTACTING CYLINDERS OF A PRINTING UNIT

[75] Inventor: Hans-Bernhard Bolza-Schunemann, Wurzburg, Fed. Rep. of Germany

[73] Assignee: Koenig & Bauer AG, Wurzburg, Fed. Rep. of Germany

[21] Appl. No.: 289,651

[22] Filed: Aug. 3, 1981

Related U.S. Application Data

[63] Continuation of Ser. No. 94,540, Nov. 15, 1979, abandoned.

[30] Foreign Application Priority Data

Jun. 30, 1979 [DE] Fed. Rep. of Germany ..... 2926570

[51] Int. Cl.[3] ..... B41F 13/20

[52] U.S. Cl. ..... 101/216

[58] Field of Search ..... 101/212, 216, 218, 219, 101/174, 175, 176, 177, 152, 153, ; 100/162 B, 163 A, 168, 176, 160; 308/22, 15, 177; 68/244, 248, 253 R, 253 C; 72/237; 29/116 AD

[56] References Cited

U.S. PATENT DOCUMENTS

| | | | |
|---|---|---|---|
| 2,362,069 | 11/1944 | Huck | 101/216 |
| 3,140,900 | 7/1964 | Martin | 100/162 B |
| 3,256,812 | 6/1966 | Karrenbauer | 101/247 X |
| 3,326,439 | 6/1967 | Sarka | 101/216 |
| 3,732,813 | 5/1973 | VirSingh | 101/247 |

FOREIGN PATENT DOCUMENTS

| | | | |
|---|---|---|---|
| 2447602 | 4/1976 | Fed. Rep. of Germany | 101/216 |
| 2701637 | 7/1978 | Fed. Rep. of Germany | 101/DIG. 10 |
| 2701670 | 7/1978 | Fed. Rep. of Germany | 101/DIG. 10 |
| 2802153 | 7/1979 | Fed. Rep. of Germany | 101/216 |
| 3076 | of 1914 | United Kingdom | 101/216 |
| 391877 | 12/1973 | U.S.S.R. | 72/237 |

*Primary Examiner*—J. Reed Fisher

*Attorney, Agent, or Firm*—Jones, Tullar & Cooper

[57] ABSTRACT

A reciprocal supporting arrangement for contacting cylinders of a printing unit is disclosed. Non-rotating supporting rings are supported by bearings carried on the cylinder shafts interiorly of the side frames. Additional cylinder bearers or cylinder rings are carried exteriorly of the side frames and thus rotate with the cylinder shafts. The combination of the non-rotating inner supports and the rotatable outer supports take the place of conventional cylinder bearers to support the cylinders of a printing press and to impart the necessary stress or tension so that the cylinders properly contact each other.

4 Claims, 1 Drawing Figure

RECIPROCAL SUPPORTING ARRANGEMENT FOR CONTACTING CYLINDERS OF A PRINTING UNIT

This is a continuation of application Ser. No. 094,540, filed Nov. 15, 1979 now abandoned.

FIELD OF THE INVENTION

The present invention is directed to an arrangement for the reciprocal support of cylinders which contact each other in a printing unit of a rotary printing press by applying non-rotating supporting bodies journalled between the side frames and the cylinders on the cylinder shafts, independent of the side frame, which reciprocally support each other, and by securing rotatable cylinder rings to the cylinder shafts exteriorly of the side frames.

DESCRIPTION OF THE PRIOR ART

The known and generally adopted measure in accordance with the prior art is an arrangement of so-called cylinder bearers or cylinder rings on the cylinder front areas, which rotate under an initial stress as may be seen in, for example, U.S. Pat. No. 2,362,069. These cylinder bearers or cylinder rings produce and maintain a correct parallel spacing of the cylinders within the side frames, prevent the cylinders from bouncing toward each other within the print-free spaces in conformity with all clearances of cylinder bearings and bearing bushings, and insure that the cylinders are in rolling contact with each other without any vibration. Without the cylinder bearers, in letterpress printing presses a so-called "edge slur" may easily occur, since the cylinder distance between the printing cylinder and the forme cylinder varies slightly depending on the impression pressure. If cylinder bearers are used and contact each other under initial stress, there is only a compensation of powers between the powers of the printing forme and the powers of the cylinder bearers, so that the load upon the journals and upon the main bearing independent of the printing forme is approximately constant. For similar reasons, the correct printing with sharp dots free from any so-called doubling can be attained best in the even more sensitive offset printing presses, if the blanket cylinder and forme cylinders roll upon each other with the cylinder bearers in contact and under an initial stress.

There is, however, one serious economic disadvantage of the cylinder bearer method for the support of the cylinders; the problem of repairs. The very precisely true-running and solid cylinder bearers which are made of special steel require the dismantling of the cylinders when being replaced, and this causes long down periods for the printing presses which cannot be tolerated. Tests using divided cylinder bearers have failed due to reasons of load and of the precision required.

There are also known printing presses which do not use cylinder bearers, that is to say without the characteristics of the special cylinder supports in addition to the main bearings. These shall only be mentioned in passing since they are subject to other limitations with respect to the utilization of friction bearings or to the production of printing of a reduced quality.

Another suggestion set forth in German Pat. No. 1,253,282 provides replacement of the cylinder bearings, which rotate with the cylinders, with ball and roller bearings, so that the problems of wear and of damages are rendered relatively harmless, whereas the initial stress forces are attained as with the employment of real cylinder bearers. This suggestion has not been realized in practice, because, as is supposed in accordance with the knowledge which led to the present invention, essential components have been lacking for enabling the production of an exact printed image.

SUMMARY OF THE INVENTION

It is an object of the present invention to provide a supporting arrangement for the cylinders of a printing unit, by means of which a function corresponding to the employment of known cylinder bearers or cylinder rings is attained, without the necessity of accepting the detrimental consequences of required repairs associated with known cylinder bearers or rings.

According to the invention there is provided an arrangement for the reciprocal support of cylinders contacting each other in a printing unit of a rotary printing press by applying supporting bodies journalled between the side frames and the cylinders on the cylinder journals, non-rotating and independent of the side frames, which reciprocally support each other, and by applying rotatable cylinder bearings on the cylinder shaft exteriorly of the side frames.

There are the following particular advantages resulting from the present invention: the advantageous functions of the cylinder bearers of the former design, such as the supporting and compensation of powers, and the precision drive and the vibration brake employed to remedy faults in the drive, are maintained. The rolling wheel drive which is subject to rapid wear is, however, now disposed separate and easily accessible outside the side frames, so that any required replacement may be done on the spot within a short space of time. The expensive dismantling of the cylinders, shipment and repair at the facilities of the manufacturers of the printing press, and the resulting down time of the press are avoided. The present invention is, therfore, of substantial economic importance and solves the problems experienced by customers and manufacturers in the employment of existing cylinder bearers.

BRIEF DESCRIPTION OF THE DRAWINGS

While the novel features of the arrangement for the reciprocal support of contacting cylinders in accordance with the present invention are set forth with particularity in the appended claims, a full and complete understanding of the invention may be had by referring to the detailed description of a preferred embodiment as set forth hereinafter and as shown in the accompanying drawing in which:

DESCRIPTION OF A PREFERRED EMBODIMENT

Figure 1:
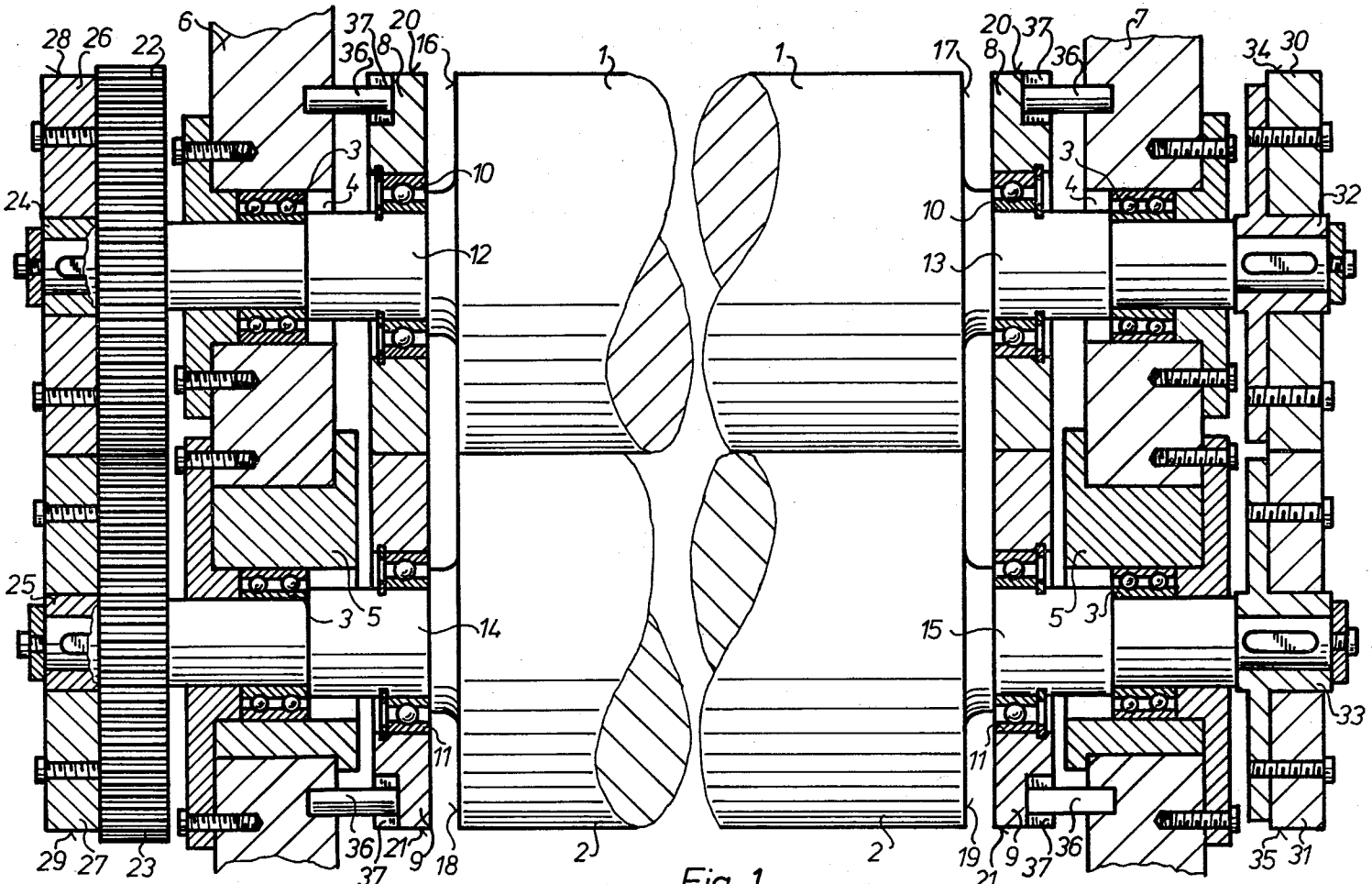
FIG. 1 is a schematic front view, partly in section, of the support for the cylinders in a printing unit in accordance with the present invention, depicted, as an example, by means of a forme cylinder and a blanket cylinder.

The present invention is based on the knowledge that the cylinder bearers have at least two quite different functions: first of all the cylinder bearers produce an initial stress, keep the cylinders spaced an exact distance from each other, and provide within the side frames for a compensation between the powers of the printing forme and the cylinder bearers, so that deflections of the journals and loads on the main bearings remain approximately constant. These requirements can be set by the arrangement of a stationary support with installed antifriction bearings or slide bearings, so that, as an advantage, the wear of the cylinder bearers or cylinder rings and the risk of damages to the cylinder surfaces because of paper wrapping and jamming is avoided. Secondly, the cylinders must supplementarily be driven by a very exact rolling-wheel drive, which rolls under an initial stress, which drives the cylinders precisely by essential peripheral forces, and which simultaneously results in a strong braking or damping of vibrations.

In accordance with the present invention, the cylinder support, which is easy to repair, comprises a combination of non-rotating bearing disks inside the side frames, and rotating cylinder rings outside the side frames. According to the invention, the supporting rings which are in a preferred embodiment, disposed inside the side frames, on strong antifriction bearings near the cylinder front areas, have the function of providing for the cylinder initial stress in the same sense as the arising forces of pressure, whereas the cylinder rings provided outside the side frames have the functions of the precise rolling-wheel drive and of the damping of vibrations.

There may be several different embodiments of the invention. Normally, stationary rings are installed instead of the conventional rotating cylinder bearers, these supporting rings being supported by means of large antifriction bearings on strong shoulders of the cylinders near the planar areas of the cylinders. The antifriction bearings are suitably encased and protected to keep out foreign matters and impurities. The supporting rings may be circular-shaped or eccentric, or provided with shoulders of equal or different height for different cylinder distances and/or for different adjustment of the initial stresses. There are also provided strong cylinder rings of wear-resistant material outside the side frames. These cylinder rings may run at one side of the cylinders either in an oil bath or dry; they may also be disposed on both sides of the cylinder outside the side frames.

In a further embodiment of the present invention, in particular if the cylinder proportions between the cylinder periphery and the paper width—with very slender cylinders—are disadvantageous, the cylinders can be rigidly fixed on either side. In this case a pair of cylinders is spaced by arising powers of pressure, by rigid supporting rings and cylinder rings, and is held together in the side frames by intermediate bearings. The cylinder rings outside the main bearings in the side frames prevent the shaft ends from deflecting, causing a reinforcement of the cylinder journals by this rigid fixation.

It may sometimes be possible to dispense with the non-rotating supporting rings inside the side frames, if the cylinders are particularly strong, that is to say if the proportion of the cylinder periphery and the paper width is advantageous, so that only cylinder rings outside the side frames may be disposed at one side or at either side. The conditions for such an arrangement are very strong cylinder journals, since if the power of pressure drops, for example in the cylinder gaps per cylinder rotation, the cylinders are in addition pressed together by the power of pressure of the rolling-wheels instead of being forced apart by powers of pressure. However, it would also be possible to use rolling rings or cylinder rings disposed outside the side frames in accordance with the present invention, which thus can easily be replaced, if needed.

The preferred embodiment, as may be seen in FIG. 1 depicts the completely installed system comprising the above-mentioned possible embodiments, in which one pair of cylinder rings may be omitted at one side, or the supporting rings inside the side frames may be omitted, as discussed above.

A pair of cylinders in cooperative relation, for example a forme cylinder 1 and a blanket cylinder 2, are supported by means of main bearings 3 in coordinated centric bearing bore-holes 4 and eccentric bearing bushings 5 in spaced side frames 6, 7 for pressure adjustment as well as for impression-on and impression-off. Cylinder 1 carries, near its planar ends 16, 17 inside the side frames 6, 7, rings 8 as supporting bearing disks. Each of these rings 8 has a rolling area 20 and is supported by means of strong antifriction bearings 10 carried on the cylinder journals 12, 13; these rings 8 and bearings 10 being encased or sealed as a protection against impurities, and contacting a cooperating ring 9 of the counter cylinder 2 under initial stress, this contact being along rolling areas 20, 21 at rings 8 and 9, respectively. Counter cylinder 2, which is in the present device a blanket cylinder, carriers near its planar areas 18, 19 inside the side frames 6, 7 as a supporting bearing disk the ring 9 with a rolling area 21, which is supported by means of strong antifriction bearings 11 on the cylinder journals 14, 15. The initial stress power is capable of being adjusted by rotation of the eccentric bearing bushings 5 which are then fixed in their desired final position. The distance between the cylinders 1 and 2 is determined by the rings 8, 9 operating as supporting bearings, and may be selected in the periphery by means of supplements or another fixed ring operating position, if there are rings of different height. Thus the initial stress power can be varied.

Main drive gears 22, 23 are disposed—outside the side frames 6, 7 and are secured on the cylinder journals 12 and 14. The hubs 24, 25 of these main drive gears 22, 23 are structured to also serve as a location for rotating cylinder rings 26, 27 positioned outside the side frames 6, 7, such cylinder rings 26, 27 being secured to the main drive gears 22, 23 by means of bolts or the like. Hubs 32, 33 are wedged onto the portions of cylinder journals 13 and 15 which protrude outside the side frame 7, these hubs 32, 33 serving as support for cylinder rings 30, 31 which are disposed outside the side frame. The cylinder rings 30, 31 are secured onto the hubs 32, 33 in a manner similar to the securement of cylinder rings 26, 27 secured to drive gears 22, 23. The cylinder rings 26, 27, 30, 31 roll under pressure on their respective rolling areas 28, 29, 34, 35 as may be seen in FIG. 1.

In the case of damage to cylinder rings 26, 27, 30 or 31, or if the cylinder distances are changed, for example because of changed heights of the printing plates or of the blankets, the cylinder rings are capable of quickly being replaced by removing them from their respective cylinder journals. Other modified embodiments are practicable, for example cylinder rings 26, 27 may be disposed close to the side frame 6, and with gears 22, 23 being disposed outside the side frame for the purpose of reducing the deflection of the journals. The cylinder rings 26, 27 may be employed at one side only; or in the case of strong cylinder journals supporting bearing disks 8 may be eliminated. The cylinder rings 26, 27, 30, 31 can be made of special steel with hardened and ground rolling areas 28, 29, 34, 35. The cylinder rings 26, 27, 30, 31 can be equipped with friction coatings for friction-pulley drives, or can be provided in any other appropriate form for the reduction of the power of pressure. The supporting rings 8, 9 or rather supporting disks may have a non-circular cross section and, are prevented from rotating by the use of appropriate means such as stationary bolts 36 engaged in slots 37 of the supporting rings 3, 9, or by springs, or brakes, or the like.

While there has hereinabove been fully and completely described a reciprocal supporting arrangement for contacting cylinders of a printing unit in accordance with the present invention, it will be seen that various changes can be made, for example, as set forth above without departing from the true spirit and scope of the invention and that the invention is accordingly to be limited only by the appended claims.

I claim:

1. An arrangement for the precise support and rotation of first and second cylinders which contact each other in a printing unit of a rotary printing press, the cylinders being carried on shafts which rotate in journals that are carried in spaced side frames, the cylinders being positioned between the spaced side frames, said support arrangement comprising:

spaced pairs of non-rotating support rings carried by the shafts of the first and second cylinders, said support rings on the first cylinder shaft contacting said support rings on the second cylinder shaft to produce an initial stress force between said pairs of support rings to maintain the cylinders spaced an exact distance from each other and to maintain journal deflections constant, said support rings being positioned adjacent planar ends of the cylinders interiorly of the side frames, and being constrained from rotation with the shafts;

at least a first pair of contacting rotatable cylinder rings, one of said rotatable cylinder rings being secured to the shaft of the first cylinder for rotation therewith, and another of said rotatable cylinder rings being secured to the shaft of the second cylinder for rotation therewith, said rotatable cylinder rings being sized to provide a selected peripheral contact force between said cylinder rings to ensure a precise rolling drive for the cylinders and to dampen vibrations, said cylinder rings contacting each other exteriorly of the side frames; and, drive means to rotate the first and second cylinders.

2. The support arrangement of claim 1 wherein said rotatable cylinder rings are equipped with friction coatings in the areas which contact each other.

3. The support arrangement of claim 1 wherein said rotatable cylinder rings are secured to main drive gears for the first and second cylinders, said main drive gears being carried on the cylinder shafts exteriorly of the side frames, the drive gears providing said drive means.

4. The support arrangement of claim 1 further including a second pair of rotatable cylinder rings, said second pair of cylinder rings being secured on hubs carried on the shafts of the cylinders exteriorly of the side frames and at the opposite ends of the shafts from said first pair of rotatable cylinder rings.

* * * * *